US008375716B2

(12) United States Patent
Ramaswamy et al.

(10) Patent No.: US 8,375,716 B2
(45) Date of Patent: Feb. 19, 2013

(54) OPERATING A SUB-SEA ORGANIC RANKINE CYCLE (ORC) SYSTEM USING INDIVIDUAL PRESSURE VESSELS

(75) Inventors: Sitaram Ramaswamy, West Hartford, CT (US); Sean P. Breen, Holyoke, MA (US)

(73) Assignee: United Technologies Corporation, Hartford, CT (US)

( * ) Notice: Subject to any disclaimer, the term of this patent is extended or adjusted under 35 U.S.C. 154(b) by 401 days.

(21) Appl. No.: 12/808,625

(22) PCT Filed: Dec. 21, 2007

(86) PCT No.: PCT/US2007/026216

§ 371 (c)(1),
(2), (4) Date: Jun. 16, 2010

(87) PCT Pub. No.: WO2009/082372

PCT Pub. Date: Jul. 2, 2009

(65) Prior Publication Data

US 2011/0138809 A1 Jun. 16, 2011

(51) Int. Cl.
*F03G 7/06* (2006.01)
*F03G 7/04* (2006.01)
*F03G 4/00* (2006.01)

(52) U.S. Cl. ..... 60/641.2; 60/641.1; 60/641.6; 60/641.7

(58) Field of Classification Search ..... 60/641.1, 60/641.2, 641.6, 641.7
See application file for complete search history.

(56) References Cited

U.S. PATENT DOCUMENTS 3,857,244 A * 12/1974 Faucette ..... 60/641.2

(Continued)

FOREIGN PATENT DOCUMENTS

JP 62000608 A * 1/1987
WO WO 03/081038 A1 10/2003

(Continued)

OTHER PUBLICATIONS

L.A. Vega, Ph.D., "Ocean Thermal Energy Conversion (OTEC)", OTEC-Dec. 1999, pp. 1-23.

(Continued)

*Primary Examiner* — Thomas Denion
*Assistant Examiner* — Daniel Wagnitz
(74) *Attorney, Agent, or Firm* — Kinney & Lange, P.A.

(57) ABSTRACT

A method and system for generating electrical power for sub-sea applications includes assembling each of the main components (132, 138, 142, 146) of an organic Rankine cycle (ORC) system (100) inside a pressure vessel to form a series of vessels (104, 106, 108, 110) removably connected to one another and configured to be placed near, on or below a sea floor. The main components of the ORC system include an evaporator (132), a turbine (138), a condenser (142) and a pump (146). A working fluid (135) is circulated through the pressure vessels in order to generate mechanical shaft power that is converted to electrical power (P). In some embodiments, the ORC system includes at least one redundant component that corresponds to one of the main components. The working fluid may be circulated through at least one redundant ORC component such that the ORC system is able to continue operating when one of more of the main components is not operating properly. A control system (148) is used to monitor operation of the main components and at least one redundant ORC component. In some embodiments, at least one redundant ORC component is housed in a pressure vessel with its corresponding main component. In other embodiments, at least one redundant ORC component is housed in a separate pressure vessel.

20 Claims, 8 Drawing Sheets

U.S. PATENT DOCUMENTS

| | | | | |
|---|---|---|---|---|
| 3,953,972 | A * | 5/1976 | Awerbuch et al. | 60/641.5 |
| 3,988,896 | A * | 11/1976 | Matthews | 60/641.4 |
| 4,104,535 | A * | 8/1978 | Bronicki | 290/52 |
| 4,112,687 | A * | 9/1978 | Dixon | 60/641.6 |
| 4,200,807 | A | 4/1980 | Humiston | |
| 4,444,015 | A * | 4/1984 | Matsumoto et al. | 60/648 |
| 4,712,380 | A | 12/1987 | Smith | |
| 5,555,731 | A * | 9/1996 | Rosenblatt | 60/671 |
| 5,613,362 | A * | 3/1997 | Dixon | 60/649 |
| 5,775,107 | A * | 7/1998 | Sparkman | 60/641.8 |
| 5,911,684 | A * | 6/1999 | Shnell | 60/641.2 |
| 6,035,643 | A * | 3/2000 | Rosenblatt | 60/651 |
| 6,494,042 | B2 | 12/2002 | Bronicki | |
| 6,539,718 | B2 * | 4/2003 | Bronicki et al. | 60/641.2 |
| 6,575,248 | B2 * | 6/2003 | Zhang et al. | 166/338 |
| 6,647,716 | B2 * | 11/2003 | Boyd | 60/398 |
| 6,867,364 | B2 * | 3/2005 | Hafskjold et al. | 174/50 |
| 6,873,063 | B1 * | 3/2005 | Appleford et al. | 307/149 |
| 6,880,344 | B2 * | 4/2005 | Radcliff et al. | 60/772 |
| 6,962,051 | B2 | 11/2005 | Radcliff | |
| 6,964,168 | B1 * | 11/2005 | Pierson et al. | 60/670 |
| 6,981,377 | B2 * | 1/2006 | Vaynberg et al. | 60/641.8 |
| 6,986,251 | B2 | 1/2006 | Radcliff et al. | |
| 6,989,989 | B2 | 1/2006 | Brasz et al. | |
| 6,998,724 | B2 | 2/2006 | Johansen et al. | |
| 7,013,644 | B2 | 3/2006 | Radcliff et al. | |
| 7,013,645 | B2 | 3/2006 | Brewington | |
| 7,038,329 | B1 | 5/2006 | Fredette et al. | |
| 7,043,912 | B1 | 5/2006 | Radcliff et al. | |
| 7,100,380 | B2 | 9/2006 | Brasz et al. | |
| 7,121,906 | B2 * | 10/2006 | Sundel | 440/3 |
| 7,146,813 | B2 | 12/2006 | Brasz et al. | |
| 7,174,716 | B2 | 2/2007 | Brasz et al. | |
| 7,178,337 | B2 * | 2/2007 | Pflanz | 60/641.2 |
| 7,224,080 | B2 | 5/2007 | Smedstad | |
| 7,254,949 | B2 | 8/2007 | Brasz et al. | |
| 7,281,379 | B2 | 10/2007 | Brasz | |
| 7,289,325 | B2 | 10/2007 | Brasz et al. | |
| 7,290,393 | B2 | 11/2007 | Cogswell et al. | |
| 7,340,899 | B1 * | 3/2008 | Rubak et al. | 60/641.8 |
| 7,493,763 | B2 * | 2/2009 | Klochko et al. | 60/641.7 |
| 7,665,304 | B2 * | 2/2010 | Sundel | 60/671 |
| 7,735,324 | B2 | 6/2010 | Brasz et al. | |
| 2004/0226296 | A1 * | 11/2004 | Hanna et al. | 60/671 |
| 2005/0179263 | A1 | 8/2005 | Johansen et al. | |
| 2006/0026961 | A1 * | 2/2006 | Bronicki | 60/641.2 |
| 2009/0217664 | A1 * | 9/2009 | Rapp et al. | 60/641.6 |
| 2009/0260358 | A1 * | 10/2009 | Rapp et al. | 60/641.7 |
| 2010/0031652 | A1 * | 2/2010 | Shnell | 60/641.2 |
| 2010/0154381 | A1 * | 6/2010 | Rapp et al. | 60/39.181 |
| 2010/0283263 | A1 * | 11/2010 | Schilling | 290/1 R |
| 2011/0126539 | A1 * | 6/2011 | Ramaswamy et al. | 60/641.2 |
| 2012/0111004 | A1 * | 5/2012 | Conry | 60/641.2 |
| 2012/0174581 | A1 * | 7/2012 | Vaughan et al. | 60/641.2 |

FOREIGN PATENT DOCUMENTS

| | | | |
|---|---|---|---|
| WO | WO 2005/095795 | A1 | 10/2005 |
| WO | WO 2006/104490 | A1 | 10/2006 |
| WO | WO 2007/072200 | A1 | 6/2007 |
| WO | WO 2007/073365 | A1 | 6/2007 |

OTHER PUBLICATIONS

Official Search Report and Written Opinion in counterpart foreign Application No. PCT/US2007/026216, filed Dec. 21, 2007.

* cited by examiner

OPERATING A SUB-SEA ORGANIC RANKINE CYCLE (ORC) SYSTEM USING INDIVIDUAL PRESSURE VESSELS

BACKGROUND

The present disclosure relates to an organic Rankine cycle (ORC) system. More particularly, the present disclosure relates to using an ORC system for sub-sea applications, whereby the main components of the ORC system are housed in separate pressure vessels.

In downhole oil and gas wells, electrical power may be required for various pieces of equipment and accessories, such as well telemetry equipment, well logging equipment, sensors, telecommunication devices, and equipment for pumping oil to the surface oil rig. Electrical power may be supplied from the surface (i.e. from the oil rig); however, this requires electrical wiring to span large distances. Alternatively, fuel cells and/or batteries may also be used as power sources in sub-sea applications.

Rankine cycle systems are commonly used for generating electrical power, and have been used in sub-sea applications. However, the sub-sea operating environment requires large and expensive equipment. There is a need for an improved method and system of producing electrical power for sub-sea applications.

SUMMARY

A method and system is described herein for generating electrical power for sub-sea applications using an organic Rankine cycle (ORC) system having an evaporator, a turbine, a condenser and a pump, which are defined as main components of the ORC system. The method comprises assembling each of the main components inside a separate pressure vessel to form a series of vessels removably connected to one another and configured to be placed near, on or below a sea floor. A working fluid is circulated through the pressure vessels in order to generate mechanical shaft power that is converted to electrical power.

In some embodiments, the ORC system includes at least one redundant ORC component selected from a group consisting of a second evaporator, a second turbine, a second condenser and a second pump. The working fluid may be circulated through at least one redundant ORC component such that the ORC system is able to continue operating when one or more of the main components is not operating properly. A control system is used to monitor operation of the evaporator, the turbine, the condenser, the pump and at least one redundant ORC component. In some embodiments, at least one redundant ORC component is housed in a pressure vessel with a corresponding main component. In other embodiments, at least one redundant ORC component is housed in a separate pressure vessel.

It is noted that the figures are not to scale.

DETAILED DESCRIPTION

A Rankine cycle system may be used to generate electrical power that is used for operation of downhole oil and gas wells. The Rankine cycle system uses waste heat and a working fluid (i.e. water) to drive a generator that produces electrical power. An organic Rankine cycle (ORC) system operates similarly to a traditional Rankine cycle, except that an organic Rankine cycle (ORC) system uses an organic fluid, instead of water, as the working fluid. Because some of the organic working fluids vaporize at a lower temperature than water, a lower temperature waste heat source may be used in an ORC system.

To optimize efficiency in sub-sea applications, the ORC system is preferably placed on or near the sea floor so that it is relatively close to where the electrical power is to be supplied. As described below, unique challenges exist in sub-sea operation of an ORC system. The system and method described herein includes an ORC system in which each of the main components of the ORC system is housed in a separate pressure vessel. In some embodiments, the main components of the ORC system have corresponding redundant components, which may be used in parallel with the main component or in place of the main component.

Figure 1:
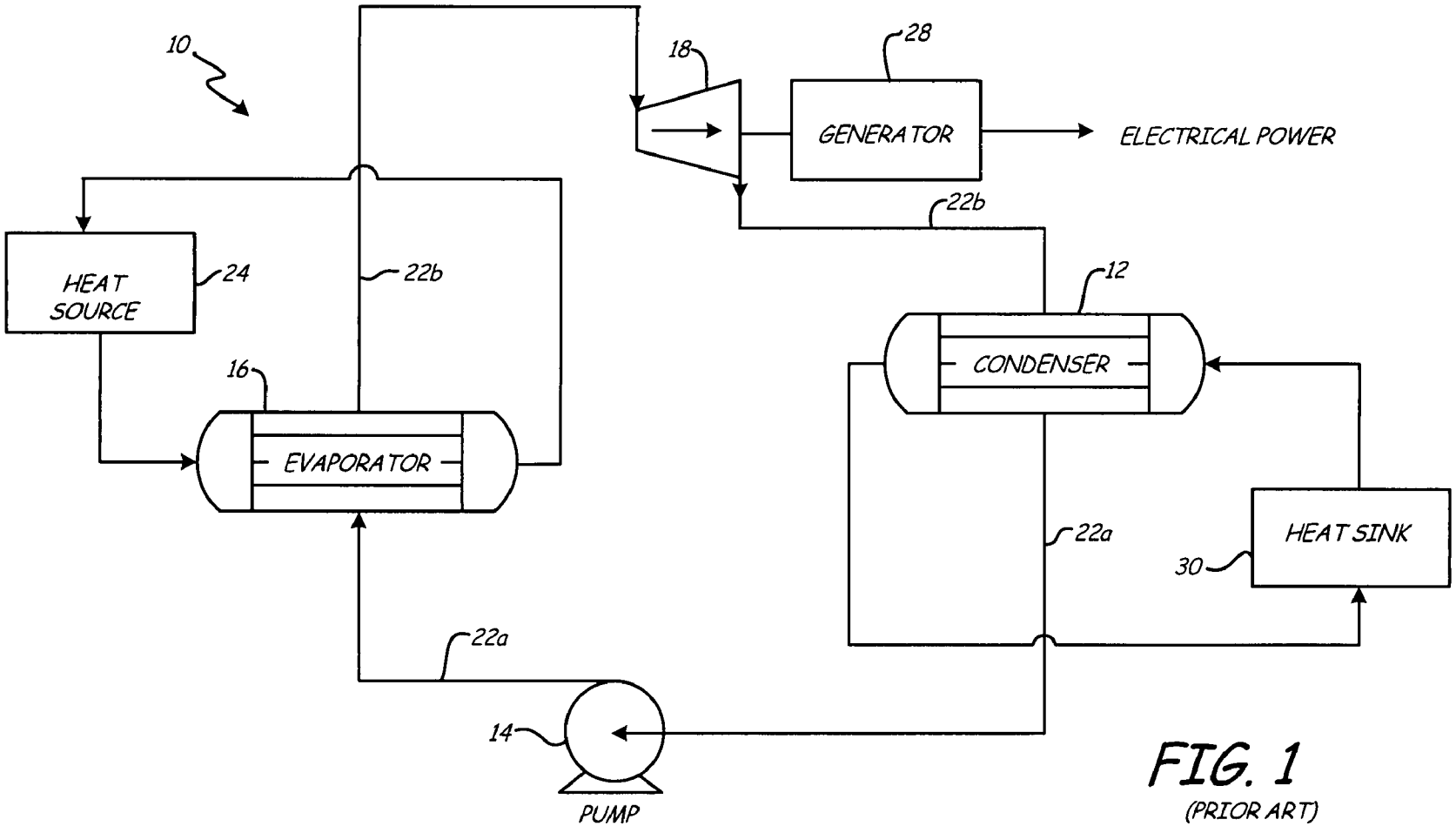
FIG. 1 (PRIOR ART)
FIG. 1 is a block diagram of an organic Rankine cycle (ORC) system designed to produce electrical power using waste heat.

FIG. 1 is a schematic of a traditional ORC system 10, which includes condenser 12, pump 14, evaporator 16, and turbine 18. Organic working fluid 22 circulates through system 10 and is used to generate electrical power. Liquid working fluid 22*a* from condenser 12 passes through pump 14, resulting in an increase in pressure. High pressure liquid fluid 22*a* enters evaporator 16, which utilizes heat source 24 to vaporize fluid 22. Heat source 24 may include, but is not limited to, any type of waste heat resource, including reciprocating engines, fuel cells, and microturbines, and other types of heat sources such as solar, geothermal or waste gas. Working fluid 22 exits evaporator 16 as a vapor (22*b*), at which point it passes into turbine 18. Vaporized working fluid 22*b* is used to drive turbine 18, which in turn powers generator 28 such that generator 28 produces electrical power. Vaporized working fluid 22*b* exiting turbine 18 is returned to condenser 12, where it is condensed back to liquid 22*a*. Heat sink 30 is used to provide cooling to condenser 12.

For sub-sea applications in which the electrical power from ORC system 10 is used for oil well equipment, heat source 24 may be a sub-sea geothermal source (for example, oil being removed from an oil well). For purposes of this disclosure, oil refers to oil or an oil and water mixture. In preferred embodiments, ORC system 10 uses the same geothermal source that is being extracted by the drilling equipment. In an alternative embodiment, a dedicated geothermal source may be used by the ORC system. Heat sink 30 may be the surrounding cold sea water. At the sea depths for oil drilling applications, the water temperature is approximately 39 degrees Fahrenheit (approximately 4 degrees Celsius).

Given the availability of a heat source and a heat sink, ORC system 10 is well-suited for producing electrical power for operation of the oil well and other equipment. An ORC system like system 10 of FIG. 1 would generally have all of its main components contained within a single pressure vessel. In some cases, condenser 12 may be contained outside of the pressure vessel. In either case, the pressure vessel would have to be large enough to contain all of the components of system 10, as shown in FIG. 1, with the possible exception of condenser 12. The pressure vessel would be located on or just above the sea floor; alternatively, the pressure vessel could be located below the sea floor. In any case, the pressure vessel is subject to large pressures and consequently must be built accordingly.

This makes the housing for ORC system 10 expensive. Moreover, accessibility to the components inside the pressure vessel is limited and requires shut-down of system 10.

Figure 2:
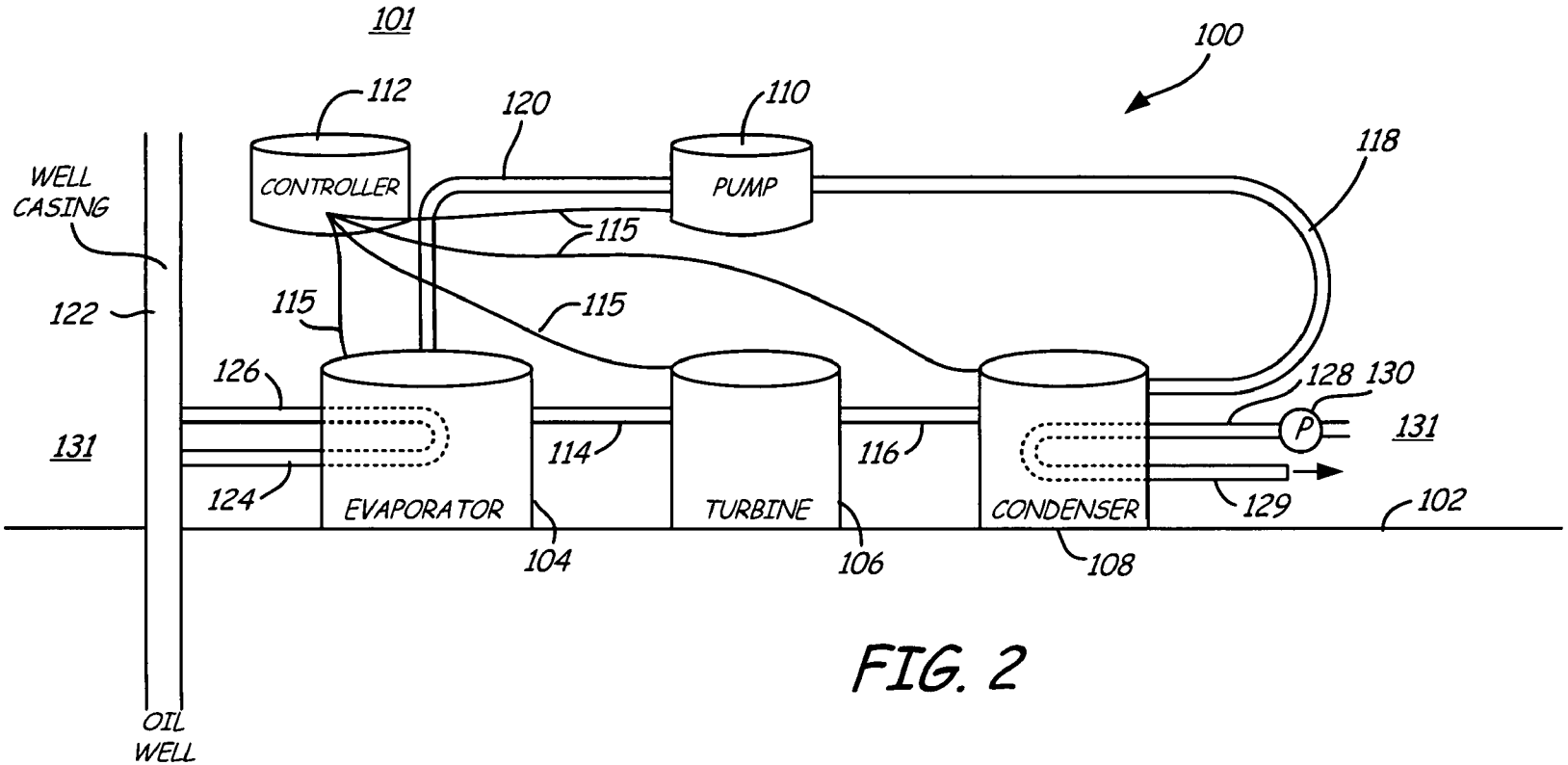
FIG. 2 is a schematic of an ORC system installed on a sea floor. Each of the main components of the ORC system is housed in a separate pressure vessel.

FIG. 2 is a schematic of ORC system 100 located on sea floor 102 of sea 101 and including first pressure vessel 104, second pressure vessel 106, third pressure vessel 108, fourth pressure vessel 110, and fifth pressure vessel 112. First pressure vessel 104 houses an evaporator and is removably connected to second pressure vessel 106 through piping segment 114. Second pressure vessel 106 is also removably connected to third pressure vessel 108 through piping segment 116, and houses a turbine. Similarly, third pressure vessel 108 is removably connected to fourth pressure vessel 110 by piping segment 118. A condenser is contained within vessel 108. Forth pressure vessel 110 houses a pump and is removably connected to third pressure vessel 108 and first pressure vessel 104. Piping segment 120 connects fourth pressure vessel 110 to first pressure vessel 104. First, second, third and fourth pressure vessels 104, 106, 108 and 110 are removably connected to one another via piping segments 114, 116, 118 and 120 such that a working fluid is able to circulate through ORC system 100, as described above in reference to FIG. 1.

Fifth pressure vessel 112 contains a control system for controlling operation of ORC system 100, and is discussed further below.

As illustrated in FIG. 2, first pressure vessel 104 is also removably connected to oil well casing 122 by piping segments 124 and 126. Oil well casing 122 is used to deliver oil from an oil well to a surface oil rig (not shown). A mixture of oil and hot water passes through well casing 122; the geothermal mixture is at a temperature ranging between approximately 200 and 350 degrees Fahrenheit (93 and 177 degrees Celsius). This geothermal mixture of oil and water is used as a heat source for the evaporator in pressure vessel 104. In the exemplary embodiment shown in FIG. 2, a portion of the oil passing through well casing 122 is bypassed into piping segment 124, where it is then directed through the evaporator in pressure vessel 104. The oil then travels back to well casing 122 through piping segment 126. In this embodiment, ORC system 100 is able to use a geothermal source already being extracted. In an alternative embodiment, the ORC system may have its own dedicated oil well to extract oil used strictly as a heat source for the evaporator of the ORC system.

As stated above, the geothermal source from the oil well is commonly a mixture of oil and water. In some cases, it may be a two phase mixture of oil, water and gas. In some embodiments, the sub-sea geothermal source may be essentially all hot water and essentially no oil. In other embodiments, the sub-sea geothermal source may be a water and gas mixture.

The condenser of ORC system 100, which is housed in pressure vessel 108, may be a water-cooled condenser. Piping segments 128 and 129 may be removably connected to third pressure vessel 108. Piping segment 128 is open on one end and pump 130 is configured to pump cold sea water 131 through piping 128 and into pressure vessel 108. Depending in part on a depth of sea 101, sea water 131 near sea floor 102 may be at a temperature ranging between approximately 32 and 72 degrees Fahrenheit (zero and 22 degrees Celsius). At depths greater than approximately 1000 meters (1094 yards), the water temperature is typically less than about 40 degrees Fahrenheit (about 5 degrees Celsius). As such, cold sea water 131 is well suited as a heat sink for the condenser inside pressure vessel 108. After passing through the condenser, sea water 131 is recycled back into sea 101 through piping 129.

Piping segments 114, 116, 118, 120, 124, 126, 128 and 129 may be, for example, stainless steel piping which is attached to pressure vessels 104, 106, 108 and 110 through traditional welding techniques. Other known fittings may also be used, particularly those well suited for underwater applications. In preferred embodiments, quick connect fittings are used so that pressure vessels 104, 106, 108 and 110 may be easily disconnected from ORC system 100 and other pressure vessels may be added into system 100.

As shown in FIG. 2, pressure vessel 112, which contains a control system, has wired connection to pressure vessels 104, 106, 108 and 110 via wires 115. Wires 115 may be configured to provide an electrical connection or an optical connection between the control system inside pressure vessel 112 and the ORC components inside pressure vessels 104, 106, 108 and 110. In an alternative embodiment, sonar transmission could be used for communicating between the control system and the ORC components. In yet another embodiment, some of the electrical wires connecting the controller of vessel 112 to the ORC components could be contained with piping segments 114, 116, 118 and 120. Each of the ORC components of ORC system 100 requires electrical power for operation. As such, wires may be used to deliver electrical power to the ORC components. In an alternative embodiment, the electrical power lines could also be used as communication lines between the control system and the ORC components.

In the exemplary embodiment shown in FIG. 2, the pressure vessels of ORC system 100 are placed directly on sea floor 102. The pressure vessels may alternatively be elevated slightly above sea floor 102. For example, some or all of the pressure vessels may be on stilts or on a platform. Moreover, some or all of the pressure vessels may be placed below sea floor 102. Various configurations are possible; however, it is preferred that the pressure vessels of ORC system 100 are located close to the geothermal heat source (i.e. oil) to be used by the evaporator. In addition, ORC system 100 should be located close to the equipment intended to receive the electrical power produced by ORC system 100.

Figure 3:
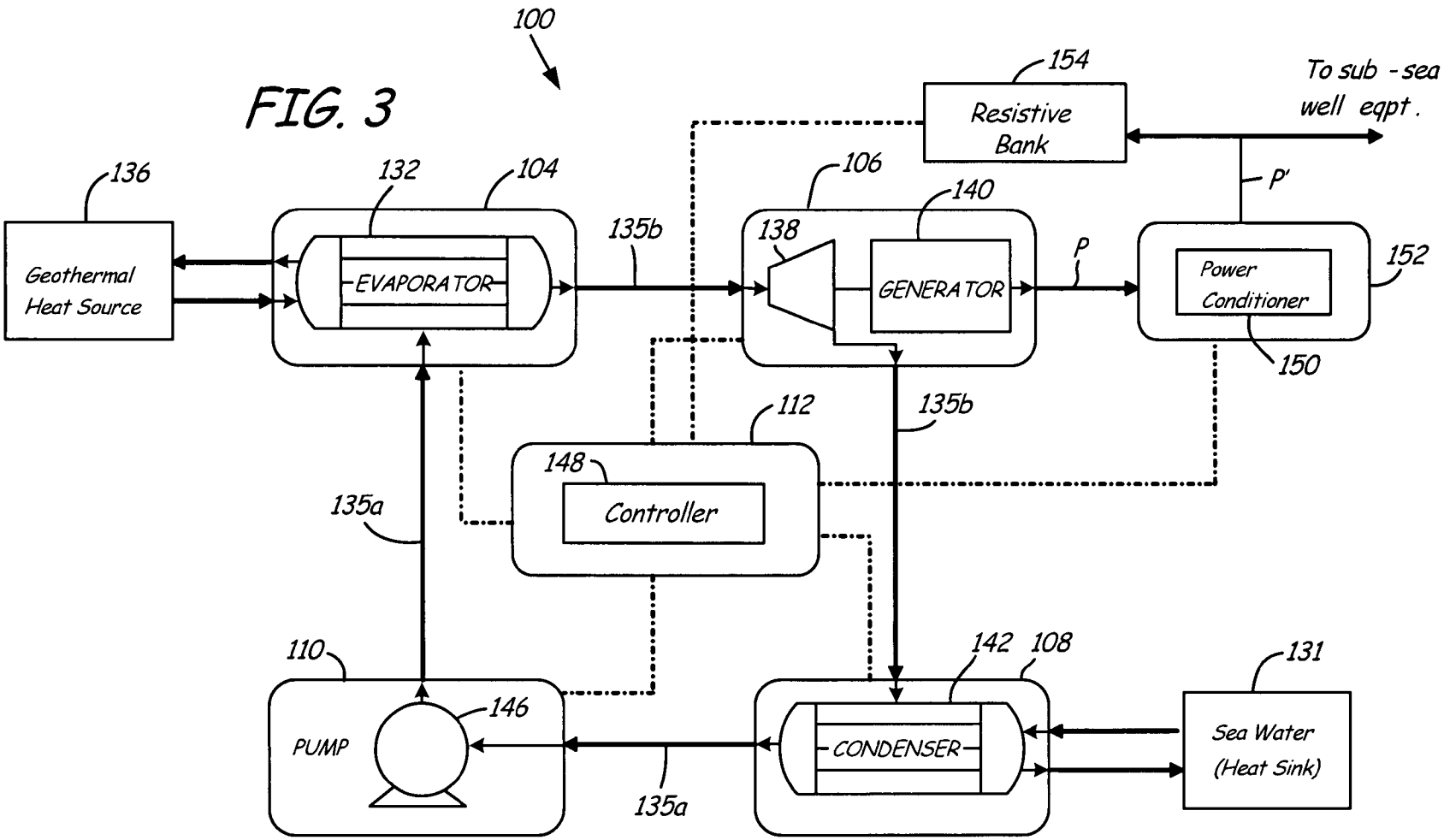
FIG. 3 is a block diagram of the ORC system of FIG. 2.

FIG. 3 is a block diagram of ORC system 100 of FIG. 2 and includes first, second, third, fourth and fifth pressure vessels 104, 106, 108, 110, and 112. Evaporator 132 is contained within first pressure vessel 104. As similarly described above in reference to ORC system 10 of FIG. 1, organic working fluid 135 enters first pressure vessel 104 as a high pressure liquid 135*a* and passes through evaporator 132. Sub-sea geothermal heat source 136 (from well casing 122 of FIG. 2) also passes through evaporator 132 and vaporizes working fluid 135. Vaporized working fluid 135*b* exits pressure vessel 104 and passes through to second pressure vessel 106, which contains turbine 138 and generator 140. Vaporized working fluid 135*b* expands to drive turbine 138, which produces mechanical shaft energy. Turbine 138 is coupled to generator 140 such that the mechanical shaft energy from turbine 138 is converted to electrical power P. Vaporized working fluid 135*b* exits second pressure vessel 106 and passes through to third pressure vessel 108 and condenser 142 housed inside vessel 108. Sea water 131 is pumped out of sea 101 and enters vessel 108 such that it circulates through condenser 142 and functions as a heat sink to condense working fluid 135 back to liquid 135*a*. Pump 146 is contained within fourth pressure vessel 110 and is used to increase a pressure of liquid working fluid 135*a*, which is then recycled back to first pressure vessel 104 and evaporator 132.

Evaporator 132, turbine 138, condenser 142 and pump 146 are the main components of ORC system 100. Controller 148 contained within fifth pressure vessel 112 controls operation of each of the main components of ORC system 100. Sensors are used to sense various parameters of each of the main components and relay the sensed parameters to controller 148. This is described in further detail below in reference to FIG. 5. Controller 148 thus monitors whether the components of ORC system 100 are operating properly.

In the exemplary embodiment shown in FIG. 3, ORC system 100 includes power conditioner 150, which is housed inside sixth pressure vessel 152. Power conditioner 150 is not an essential component of ORC system 100, but is included in preferred embodiments. Electrical power P generated inside second pressure vessel 106 passes into pressure vessel 152 and to power conditioner 150, where electrical power P is conditioned to an appropriate voltage for direct current (DC), or an appropriate voltage, frequency, phase and power factor for alternating current (AC). Conditioned electrical power P' may then be distributed to sub-sea well equipment as needed. During times in which power is not being demanded by the sub-sea well equipment, conditioned electrical power P' may be distributed to resistive bank 154, which may act as an artificial load for ORC system 100. Resistive bank 154 may use cold sea water for cooling, similar to condenser 142. Controller 148 may also monitor and control operation of power conditioner 150 and resistive bank 154.

As shown in FIG. 3, turbine 138 and generator 140 are housed within a single pressure vessel (i.e. vessel 106). In other embodiments, turbine 138 and generator 140 may be in separate pressure vessels connected to one another. However, for efficiency purposes, it is preferred that turbine 138 and generator 140 are housed in a single pressure vessel. Power conditioner 150 is shown inside pressure vessel 152 and electrical power P passes from second pressure vessel 106 to pressure vessel 152. In alternative embodiments, power conditioner 150 may be housed in the same pressure vessel as generator 140 (i.e. pressure vessel 106).

ORC system 100 utilizes sub-sea geothermal source 136 (i.e. oil or oil/water mixture) as a heat source and sea water 131 as a heat sink. As described above, oil 136 from well casing 122 passes directly through evaporator 132 to vaporize working fluid 135. In an alternative embodiment, a heat exchanger (not shown) may be housed inside pressure vessel 104. Oil 136 may pass through the heat exchanger, instead of evaporator 132, and transfer heat to an intermediary fluid, which then passes through evaporator 132. Similarly, third pressure vessel 108 may also contain a heat exchanger (not shown). Instead of passing directly through condenser 142, sea water 131 may pass through the heat exchanger and receive heat from an intermediary fluid, which then passes through condenser 142. (See FIG. 5A.) Heat exchangers may be used in pressure vessels 104 and/or 106 to avoid any issues with using oil and sea water (salt water) inside evaporator 132 and condenser 142.

In the exemplary embodiment shown in FIG. 3, each of the main components of ORC system 100 is controlled by controller 148. In an alternative embodiment, some or all of the components may have a sub-controller which communicates with main controller 148. In that case, the sub-controller would generally be housed within the pressure vessel containing the ORC component.

By housing the main components of ORC system 100 in separate pressure vessels, as opposed to having the ORC system contained within a single pressure vessel, some of the challenges in designing a sub-sea ORC system are eliminated in the embodiment shown in FIGS. 2 and 3. Oil is typically extracted in areas where the sea water is deep, thus resulting in a high pressure environment at and near the sea floor. Therefore, a pressure vessel for containing an ORC system is designed with thick external walls. If all of the ORC components are to be contained within one pressure vessel, the pressure vessel would have a large diameter. As the diameter of the pressure vessel increases, the thickness of the external wall of the pressure vessel increases significantly, making the ORC system expensive. Having separate pressure vessels for each component of the ORC system allows the pressure vessels to be smaller in size and wall thickness, which may reduce material costs. Moreover, the smaller pressure vessels are easier to handle, particularly during installation. ORC system 100 is designed such that pressure vessels 104, 106, 108, 110 and 112 are removably connected to one another. From a serviceability standpoint, this allows another pressure vessel to be substituted for a pressure vessel that contains a malfunctioning component. Thus, system 100 provides greater flexibility for swapping out components.

Figure 4:
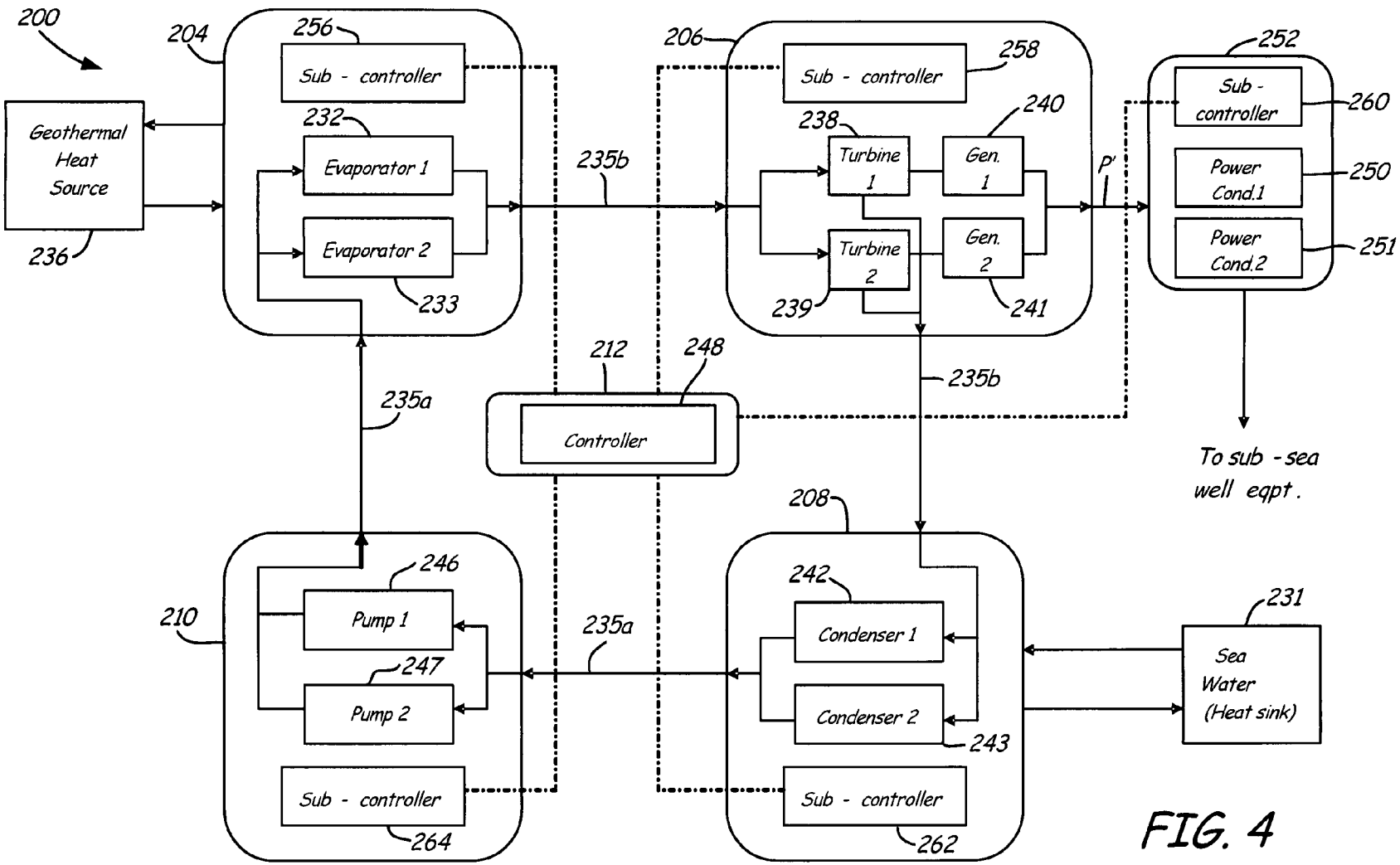
FIG. 4 is a block diagram of an alternative embodiment of the ORC system of FIG. 3. Each of the main components of the ORC system includes a redundant component and a sub-controller.

FIG. 4 is a block diagram representing another embodiment of an ORC system. ORC system 200 is similar to ORC system 100, and like reference elements are designated with the same number, except in FIG. 4 the numbers start with a "2" instead of a "1". (For example, working fluid 135 in ORC system 100 of FIG. 3 is designated as 235 in ORC system 200 of FIG. 4.) A main difference between ORC system 100 of FIG. 3 and ORC system 200 of FIG. 4 is the pressure vessels for the main components of ORC system 200 also include a redundant component designed to operate in parallel with the main component or in place of the main component.

ORC system 200 includes first pressure vessel 204, second pressure vessel 206, third pressure vessel 208, fourth pressure vessel 210, fifth pressure vessel 212 and sixth pressure vessel 252. As described above in reference to FIG. 3, ORC system 200 uses geothermal heat source 236 for heating and sea water 231 for cooling. Working fluid 235 circulates through ORC system 200. Fifth pressure vessel 212 houses main controller 248. In ORC system 200, a cascaded control system is used in which main controller 248 is connected to sub-controllers, as described below.

First pressure vessel 204 includes first evaporator 232, second evaporator 233 and first sub-controller 256. First evaporator 232 is defined as a main component of ORC system 200 and functions as the main evaporator of ORC system 200. Second evaporator 233 is defined as a redundant component or a redundant evaporator of ORC system 200. Pressure vessel 204 is configured such that working fluid 235 enters vessel 204 as liquid 235*a* and may flow through first evaporator 232 and/or second evaporator 233. Geothermal heat source 236 also enters pressure vessel 204. Although not shown in FIG. 4, geothermal heat source 236 may also pass through first evaporator 232 and/or second evaporator 233. First sub-controller 256 is configured to control whether heat source 236 and working fluid 235 pass through both or only one of evaporators 232 and 233. Sensors (not shown) may be used at an inlet and/or an outlet of evaporators 232 and 233 and relay sensed parameters to controller 256. Based on data from the sensors, controller 256 controls flow through evaporators 232 and 233 by using valves (not shown) at an inlet and/or an outlet of evaporators 232 and 233. (See FIGS. 5 and 6 and the description below for more detail on regulating flow through main evaporator 232 and redundant evaporator 233.)

Second pressure vessel 206 includes first turbine 238, second turbine 239, first generator 240, second generator 241 and second sub-controller 258. First turbine 238 and first generator 240 are defined as the main turbine and generator of ORC system 200. Second turbine 239 and second generator 241 are defined as the redundant turbine and generator of ORC system 200. First and second turbines 238 and 239 are configured to receive vaporized working fluid 235*b* passing from pressure vessel 204, and generate mechanical shaft energy convertible to electrical power P in first and second generators 240 and 241. Electrical power P from first and second generators 240 and 241 flows to sixth pressure vessel 252. Working fluid 235*b* exiting turbines 238 and 239 flows from pressure vessel 206 to pressure vessel 208.

Sixth pressure vessel 252 contains first power conditioner 250, second power conditioner 251 and sub-controller 260. Power conditioner 250 may be the main power conditioner and power conditioner 251 may be used as a redundant component or as a substitute if sub-controller 260 determines that there are problems with power conditioner 250. Conditioned power P' exits pressure vessel 252 and may then be delivered to the sub-sea well equipment.

A resistive bank has been removed from FIG. 4 for clarity; however, it is recognized that a resistive bank, similar to resistive bank 154 of FIG. 3, may be used during times when there is no electrical load or a minimal electrical load. In ORC system 200, the resistive bank may be controlled by main controller 248 or by sub-controller 260 inside pressure vessel 252. Alternatively, the resistive bank may have its own sub-controller connected to main controller 248.

Third pressure vessel 208 contains first condenser 242, second condenser 243 and sub-controller 262. First condenser 242 may be defined as a main component and second condenser 243 may be defined as a redundant component. Similar to pressure vessel 204 housing evaporators 232 and 233, pressure vessel 208 includes two inlet and two outlet streams. A first inlet stream is working fluid 135*b*, which may pass through first condenser 242 and/or second condenser 243. Vaporized working fluid 135*b* is condensed to liquid working fluid 135*a* which then passes through an outlet of pressure vessel 208 and travels to fourth pressure vessel 210. The second inlet stream is sea water 231, which acts as a heat sink. Cold sea water 231 enters pressure vessel 208 and passes through at least one of first condenser 242 and second condenser 243. Sea water 231 then exits pressure vessel 208 and is recycled back into the sea.

Working fluid 135*b* passes through at least one of first condenser 242 and second condenser 243. Valves (not shown in FIG. 4) at an inlet and/or an outlet of condensers 242 and 243 may be used to permit or suppress flow through condensers 242 and 243. Sub-controller 262 controls operation of the valves. This is described in further detail below in reference to FIGS. 5 and 6.

Fourth pressure vessel 210 includes first pump 246, second pump 247 and sub-controller 264. First pump 246 may be defined as a main component; and second pump 247 may be defined as a redundant component. Liquid working fluid 235*a* enters pressure vessel 210 and flows through first pump 246 and/or second pump 247. Sub-controller 264 controls flow through first and second pumps 246 and 247 using valves (not shown) and based upon sensed parameters inside pressure vessel 210.

Figure 5:
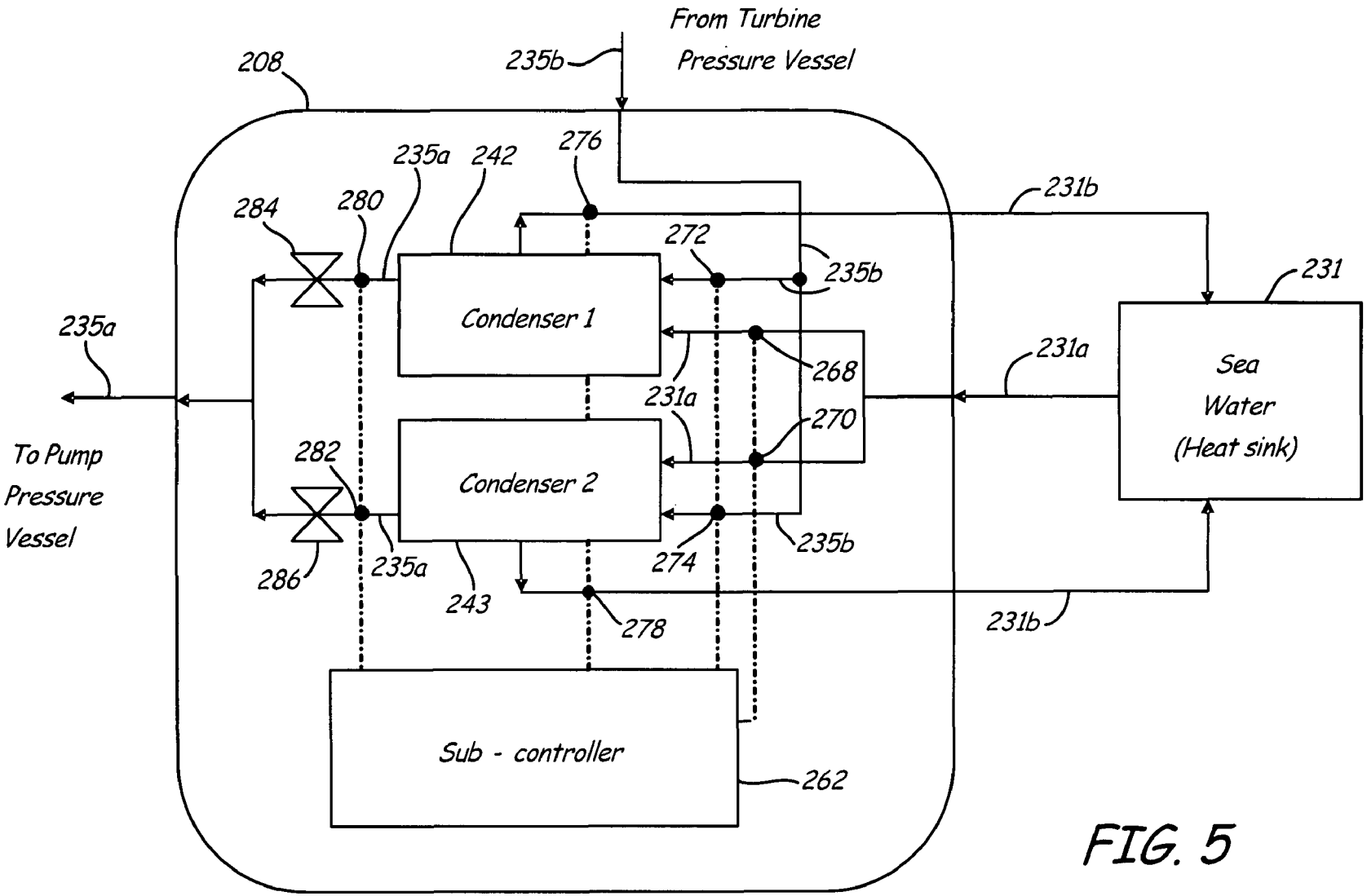
FIG. 5 is an exploded view of the condenser pressure vessel from FIG. 4, as an example, to further illustrate operation of the main condenser and the redundant condenser, as controlled by the sub-controller.

FIG. 5 is an exploded view of third pressure vessel 208 from FIG. 4 and heat sink 231 (cold sea water) to better illustrate the inlet and outlet streams of pressure vessel 208, and control of first and second condensers 242 and 243 by sub-controller 262. As explained above, vaporized working fluid 235*b* from second pressure vessel 206 flows into pressure vessel 208, which is designed such that fluid 235*b* may then flow through first condenser 242 and/or second condenser 243. Similarly, inlet stream 231*a* of cold sea water 231 enters pressure vessel 208 and may then flow through first condenser 242 and/or second condenser 243. Cold sea water 231 is used to condense vaporized fluid 235*b* such that fluid 235 condenses to liquid 235*a*. Outlet streams 231*b* from condensers 242 and 243 have absorbed heat from fluid 235. Streams 231*b* then exit pressure vessel 208 and are recycled back into the sea. In the embodiment of FIG. 5, two sea water outlet streams 231*b* are shown exiting vessel 208. It is recognized that sea water outlet streams 231*b* may be combined at some junction inside pressure vessel 208 such that one outlet stream 231*b* exits vessel 208.

Sub-controller 262 controls flow of vaporized working fluid 235*b* and sea water 231 through first and second condensers 242 and 243. Sub-controller 262 may split flow evenly through condensers 242 and 243. Alternatively, controller 262 may direct all flow through first condenser 242, unless condenser 242 is malfunctioning. This is described in further detail below in reference to FIG. 6.

To monitor and control operation of first and second condensers 242 and 243, controller 262 uses sensors at various locations inside pressure vessel 208. Sensor 268 is placed in sea water inlet stream 231*a* for first condenser 242. Sensor 270 is placed in inlet stream 231*a* for second condenser 243. Sensors 268 and 270 may sense temperatures and pressures of inlet stream 231*a*, which is then relayed to sub-controller 262. Similarly, sensors 272 and 274 are placed in inlet streams for working fluid 235*b* entering first and second condensers 242 and 243. Sensors 272 and 274 may also sense temperatures and pressures of working fluid 235*b* entering condensers 242 and 243, and the data is conveyed to sub-controller 262.

In the embodiment shown in FIG. 5, the inlet stream of working fluid 235*b* for condenser 242 and the inlet stream of working fluid 235*b* for condenser 243 each have a sensor. In an alternative embodiment, one sensor may be placed in the stream for working fluid 235*b* prior to the point at which working fluid 235*b* splits into two inlet streams. Similarly, sensors 276 and 278 are placed in each of two sea water inlet steams 231*a* entering first condenser 242 and second condenser 243. Because the two sea water inlet streams are the same, it is recognized that one sensor may be used.

Sensor 276 is shown in sea water outlet stream 231*b* from first condenser 242. Sensor 278 is similarly located in outlet stream 231*b* from second condenser 243. In this case, sensors dedicated to each condenser 242 and 243 are necessary for outlet stream 231*b* in order to separately monitor operation of condensers 242 and 243. Similarly, sensor 280 is located in an outlet stream of working fluid 235*a* from first condenser 242, and sensor 282 is located in an outlet stream of working fluid 235*a* from second condenser 243. Again, separate sensors are needed to monitor working fluid 235*a* exiting each condenser and evaluate individual performance of condensers 242 and 243. Parameters sensed by sensors 276, 278, 280 and 282 may include, but are not limited to, temperature and pressure.

As shown in FIG. 5, valve 284 is installed in the outlet stream of working fluid 235*a* from condenser 242; valve 286 is installed in the working fluid outlet stream from condenser 243. Operation of valves 284 and 286 is controlled by sub-controller 262. If valve 284 is closed, condenser 242 eventually becomes filled with working fluid 235 and additional working fluid 235*b* entering pressure vessel 208 is no longer able to enter first condenser 242. In that case, so long as valve 286 of second condenser 243 is open, all of working fluid 235*b* entering pressure vessel 208 is directed through second condenser 243.

In an alternative embodiment, valves 284 and 286 may instead be placed in the inlet streams of working fluid 235; or valves may be used in both the inlet and the outlet streams.

In the embodiment illustrated in FIG. 5, there are no valves installed in the inlet or the outlet of sea water streams 231*a* and 231*b*. Because there is essentially an unlimited amount of sea water 231 to function as a heat sink for condensers 242 and 243, it is not critical that the flow of sea water through condensers 242 and 243 be controlled. However, it is recognized that valves may be used at either an inlet or an outlet of condensers 242 and 243 to control flow of sea water 231 through condensers 242 and 243.

Pressure vessel 208 is used as an example in FIG. 5 to illustrate and describe use of sensors, valves and sub-controller 262 with condensers 242 and 243. The other pressure vessels, particularly first pressure vessel 204, second pressure vessel 206 and fifth pressure vessel 210, are similarly designed with sensors and valves. The sensors are similarly used in the other pressure vessels to sense temperatures and pressures of working fluid 235 at an inlet and an outlet of the components.

Referring to FIG. 4, pressure vessel 206 contains first turbine 238 and first generator 240, as well as second turbine 239 and second generator 241. Sensors may be placed in the inlet and the outlet stream for working fluid 235 flowing through first turbine 238 and second turbine 239. Again, temperatures and pressures are sensed and relayed to sub-controller 258. Sensors also may be placed at an inlet and an outlet of first generator 240 and second generator 241 to monitor operation of generators 240 and 241. To analyze whether generators 240 and 241 are operating properly, sensed parameters may include voltage and current.

Referring back to FIG. 5, in this embodiment, sea water 231 flows directly through condensers 242 and 243. In an exemplary embodiment in which condensers 242 and 243 are tube and shell type heat exchangers, it is preferred that sea water 231 runs inside the tubes, rather than on the shell side of the heat exchanger. The tubes of the heat exchanger are better able to handle high pressures of sea water 231.

Figure 5A:
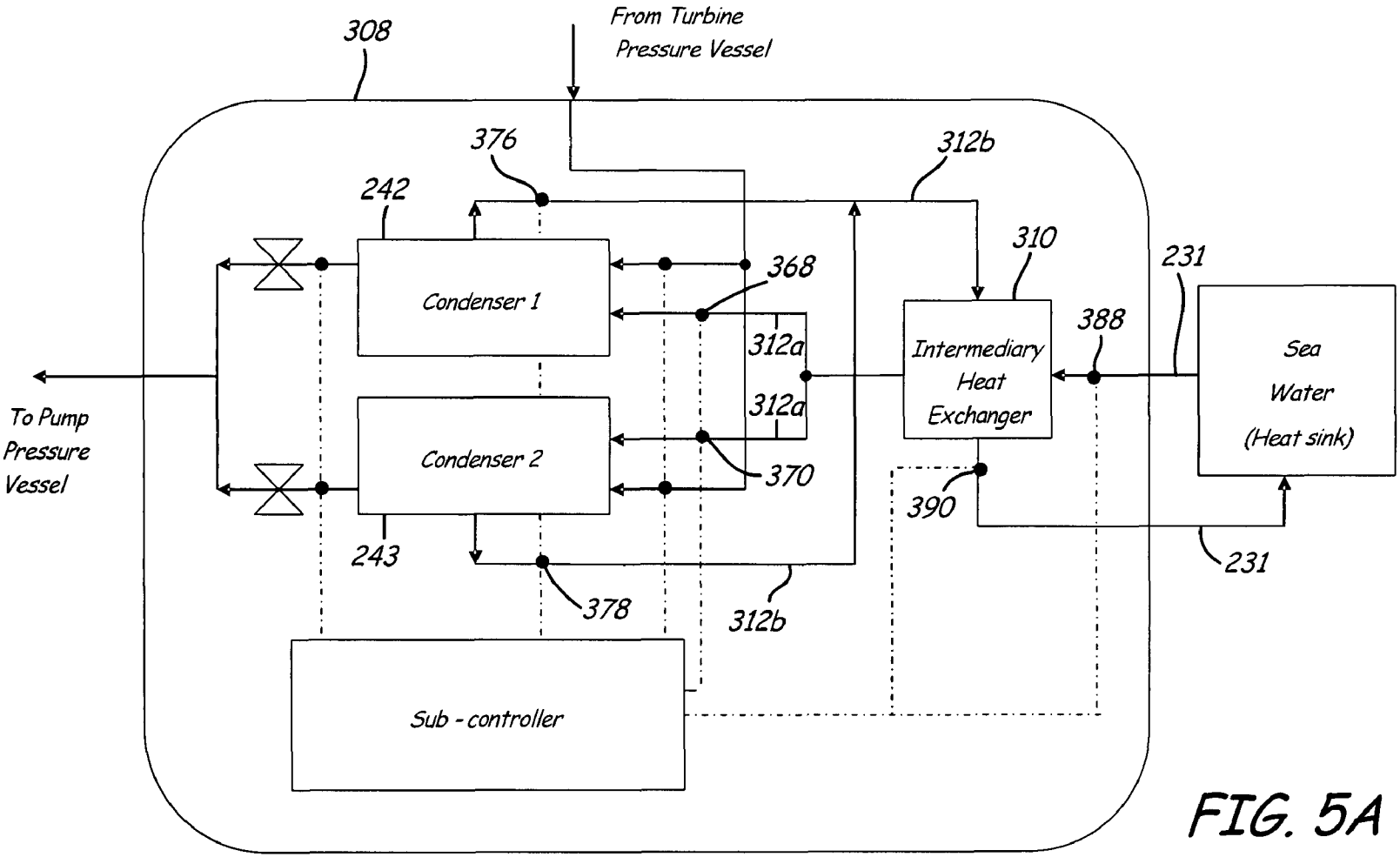
FIG. 5A is an alternative embodiment of the condenser pressure vessel of FIG. 5 and includes an intermediary heat exchanger and cooling fluid.

Given the corrosiveness of the salt in sea water 231, it may be preferred, in some cases, to use an intermediary fluid as the cooling fluid in condensers 242 and 243. FIG. 5A is an alternative embodiment to pressure vessel 208 of FIG. 5. In the embodiment shown in FIG. 5A, pressure vessel 308 includes intermediary heat exchanger 310 and cooling fluid 312. Instead of flowing sea water 231 through condenser 242 and/or condenser 243, sea water 231 flows through intermediary heat exchanger 310 and receives heat from cooling fluid 312, also flowing through heat exchanger 310. Cooling fluid 312 thus exits heat exchanger 310 at a lower temperature compared to its inlet temperature. Cooling fluid 312 then enters first condenser 242 and/or second condenser 243 as fluid 312*a* and receives heat from working fluid 235 passing through condenser 242 and/or condenser 243. Cooling fluid 312 exits condenser 242 and/or condenser 243 as fluid 312*b* and circulates back through heat exchanger 310.

As shown in FIG. 5A, sensors are used at the same input and output locations of condensers 242 and 243. Sensors 368 and 370 are installed in cooling fluid inlet streams 312*a* for condensers 242 and 243. Sensors 376 and 378 are installed in cooling fluid outlet streams 312*b*. In order to monitor operation of heat exchanger 310, sensor 388 may be installed in sea inlet stream 231*a* at an inlet side of heat exchanger 310, and sensor 390 may be installed in sea stream 231*b* at an outlet side of heat exchanger 310. Sensors 388 and 390 relay sensed parameters to sub-controller 262. Although not shown in FIG. 5A, valves may be used to control flow of cooling fluid 312 through condenser 242 and condenser 243.

Referring to FIG. 4 and first pressure vessel 204, geothermal heat source 236 is described above as passing directly through evaporator 232 and evaporator 233. In an alternative embodiment, vessel 204 may contain an intermediary heat exchanger, similar to heat exchanger 310 of FIG. 5A, which is used to transfer heat from geothermal heat source 236 to an intermediary fluid. The intermediary fluid then passes through evaporators 232 and 233 to vaporize working fluid 235.

Figure 6:
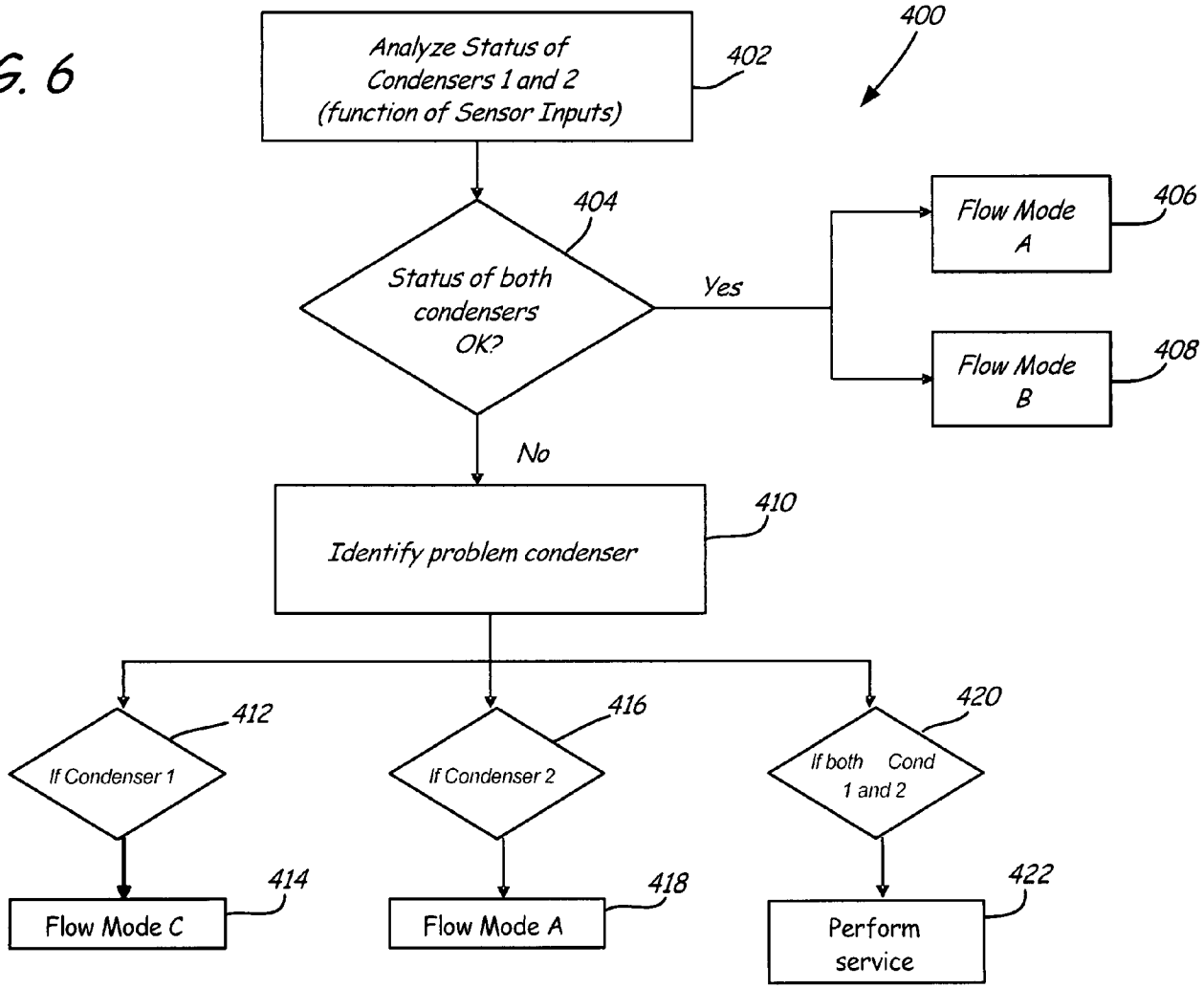
FIG. 6 is a flow diagram of a method of operating the condenser pressure vessel of FIG. 5.

FIG. 6 is a flow diagram illustrating method 400 for operating pressure vessel 208 of FIG. 5. Method 400 includes steps 402-422, and begins with analyzing the status of first condenser 242 and second condenser 243 (step 402) as a function of input from sensors 268, 270, 272, 274, 276, 278, 280 and 282. Step 402 is performed by sub-controller 262. Based on sensed parameters and a comparison among the sensed parameters, sub-controller 262 is able to conclude whether condensers 242 and 243 are operating properly. For example, based on a comparison of the inlet temperature and pressure of working fluid 235 (determined by sensor 272) and the outlet temperature and pressure of fluid 235 (determined by sensor 280), controller 262 analyzes whether condenser 242 is operating properly. Controller 262 may also use the temperature and pressure data from sensors 268 and 276.

Based on data collected in step 402, sub-controller 262 determines in step 404 the status of condenser 242 and condenser 243. If both condensers 242 and 243 are operating properly (i.e. status is OK), then Flow Mode A (step 406) or Flow Mode B (step 408) is performed. In Flow Mode A, all of working fluid 235*b* from vessel 206 is directed through first condenser 242. Therefore, valve 286 for second condenser 243 is closed. In Flow Mode B, a flow of working fluid 235*b* is split essentially evenly such that approximately half of the volume of working fluid 235*b* flows through first condenser 242 and a second half of working fluid 235*b* flows through second condenser 243.

A decision as to whether Flow Mode A or Flow Mode B is selected may be automatically programmed into sub-controller 262. For example, sub-controller 262 may be programmed to remain at Flow Mode A for a predetermined time and periodically switch to Flow Mode B to alleviate some of the load on Flow Mode A. Sub-controller 262 also may be configured such that the flow mode may automatically switch if any type of problem is detected with either condenser 242 or 243. The flow mode may also be manually changed during operation of ORC system 200.

Returning to step 404, if sub-controller 262 determines that both condensers are not operating properly (i.e. status is not OK), then a next step in method 400 is to determine which condenser is not operating properly (step 410). If sub-controller 262 determines that first condenser 242 is problematic (step 412), then Flow Mode C is selected (step 414). In Flow Mode C, distribution of working fluid 235*b* to second condenser 243 increases up to as high as 100% of the total flow of working fluid 235*b* into pressure vessel 208. Depending on which mode was in operation prior to step 204, the flow percentage going into second condenser 243 may have previously ranged from zero percent to approximately fifty percent of the total flow of working fluid 235*b* into vessel 208. In Flow Mode C, an allocation of flow between first condenser 242 and second condenser 243 may depend on a further assessment of a condition of first condenser 242. In some cases, Flow Mode C may automatically allocate all of working fluid 235*b* through second condenser 243. In that case, valve 284 would be completely closed.

Continuing with the steps in method 400, if it is instead determined that second condenser 243 is not operating properly (step 416), then Flow Mode A is selected in step 418 such that all of working fluid 235*b* is directed through first condenser 242, and valve 286 of second condenser 243 is closed.

If sub-controller 262 determines that neither first condenser 242 nor second condenser 243 is operating properly (step 420), then it may be necessary to perform service on first and second condensers 242 and 243 (step 422).

By having two condensers in pressure vessel 208, method 400 allows ORC system 200 to continue operating even when there is a problem with one of condensers 242 or 243. As such, ORC system 200 is able to maintain its power rating over a longer period, compared to an ORC system which would normally have a reduction in power output when one of the components is not operating at its maximum. Moreover, by making it feasible to split flow through two condensers and/or switch flow to one condenser as necessary, the load on each condenser 242 and 243 is reduced. As such, service problems may occur less often. If one condenser is malfunctioning, operation of ORC system 200 may continue and the malfunctioning condenser may be serviced during a scheduled shutdown of ORC system 200.

It is recognized that sub-controller 262 may fluctuate between Flow Modes A, B, and C based on predetermined parameters. Alternatively, as mentioned above, the flow modes may manually be switched.

The description of condensers 242 and 243 with reference to FIGS. 5 and 6 is an example illustrating how the components of ORC system 200 of FIG. 4 may operate and be controlled. It is recognized that the other components (i.e. evaporators 232 and 233, turbines 238 and 239, and pumps 246 and 247) may be similarly designed with sensors and valves, such that the different flow modes described above for condensers 242 and 243 may also apply to the other components.

Figure 7:
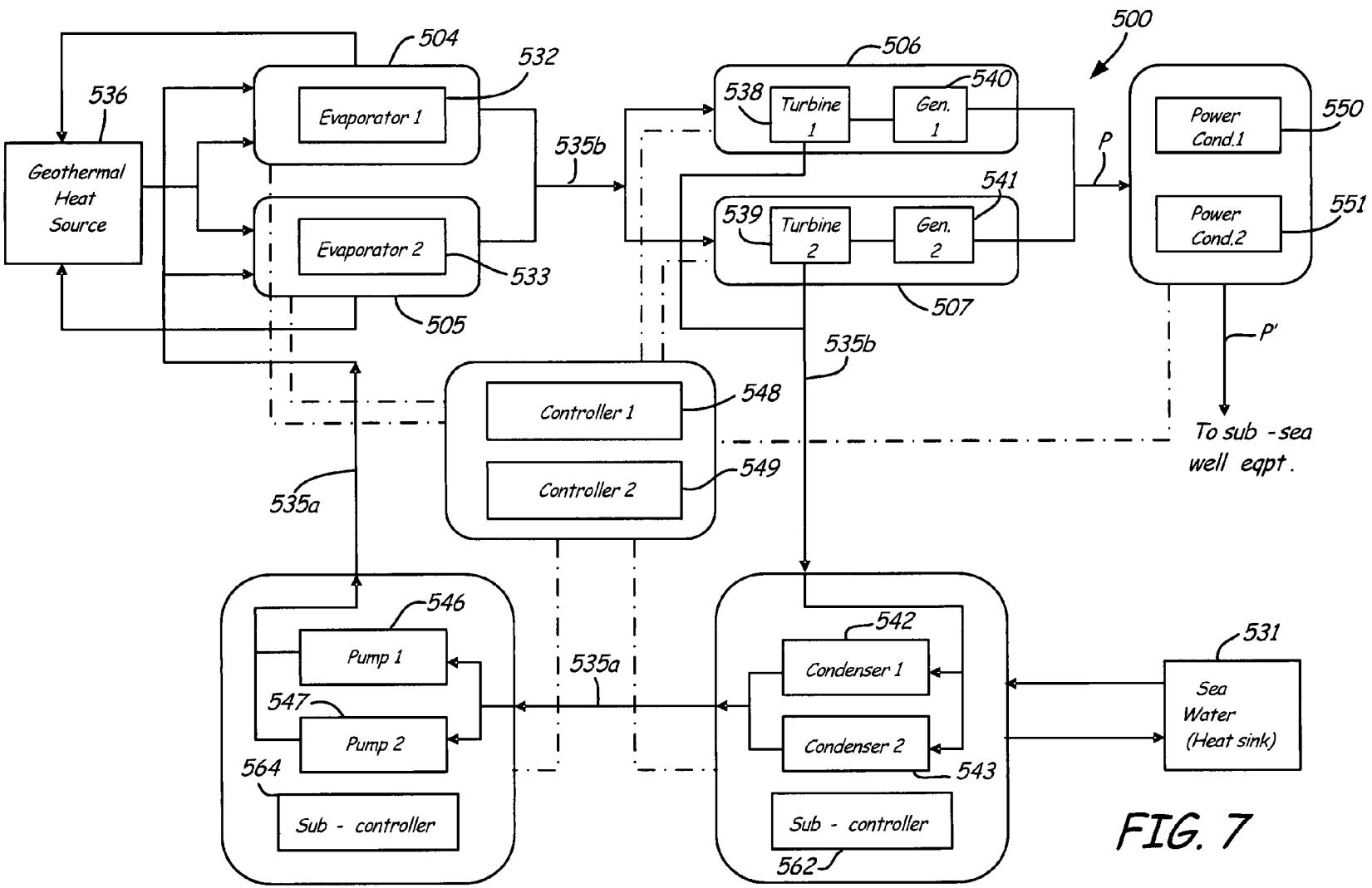
FIG. 7 is a block diagram of another alternative embodiment of an ORC system having redundant components, whereby some of the redundant components are housed in separate pressure vessels.

FIG. 7 is another embodiment of an ORC system as an alternative to ORC system 100 of FIG. 3 and ORC system 200 of FIG. 4. Similar to system 200, in ORC system 500, each of the main components of the ORC system (first evaporator 532, first turbine 538, first condenser 542, and first pump 546) also includes a redundant component (second evaporator 533, second turbine 539, second condenser 543, and second pump 547). ORC system 500 also includes first power conditioner 550 and second power conditioner 551. First and second evaporators 532 and 533 use geothermal heat source 536 (i.e. extracted oil) to vaporize working fluid 535; condensers 542 and 543 use sea water 531 to condense working fluid 535.

In the embodiment of FIG. 7, two controllers (first controller 548 and second controller 549) are shown in pressure vessel 512. First controller 548 may be designed as the main controller for ORC system 500 and second controller 549 may be used during periods when first controller 548 is not operating properly. Alternatively, second controller 549 may be substituted periodically for first controller 548. As an alternative to the embodiment of FIG. 7, first and second controllers 548 and 549 may be housed in separate pressure vessels.

As shown in FIG. 7, first evaporator 532 and second evaporator 533 are housed in separate pressure vessels. Specifically, first evaporator 532 is housed in vessel 504 and second evaporator 533 is housed in vessel 505. An evaporator sub-controller is eliminated from this embodiment; instead, first and second evaporators 532 and 533 are controlled by first controller 548 (and second controller 549). Similarly, first turbine 538 and first generator 540 are housed in pressure vessel 506; and second turbine 539 and second generator 541 are housed in pressure vessel 507. Turbines 538 and 539, and generators 540 and 541 may be controlled by first controller 548 (and second controller 549). Similarly, power conditioners 550 and 551 may be controlled directly by controllers 548 and 549.

For evaporators 532 and 533, inlet streams of working fluid 535*a* and heat source 536 are each split into two inlet streams (one for first evaporator 532 and one for second evaporator 533) upstream of pressure vessels 532 and 533. In some embodiments, valves for controlling flow into evaporators 532 and 533 may also be located in the piping upstream of vessels 532 and 533.

First condenser 542 and second condenser 543 are both shown in pressure vessel 508. Also, sub controller 562 is shown inside pressure vessel 508. It is recognized that first condensers 542 and 543 may be configured like evaporators 532 and 533 such that each is in its own pressure and controlled by main controller 548, rather than a sub-controller. The same applies for first pump 546 and second pump 547.

Various configurations of the embodiments shown in FIGS. 3, 4, 5, 5A and 7 are possible. For example, some, but not all, of the main components of an ORC system (i.e. evaporator, turbine-generator, condenser and pump) may have a redundant component. For the components having a main component and a redundant component, some of them may be housed in a single pressure vessel, and some may be housed in separate pressure vessels. Some of the components may have a dedicated sub-controller, while others may be controlled by a main controller of the ORC system.

The embodiments described herein for a sub-sea ORC system offer numerous advantages to a traditional ORC system housed in a single pressure vessel. Using pressure vessels for each of the components of the ORC system results in smaller pressure vessels that are easier to handle, and do not have the wall thickness requirements of a large pressure vessel. Moreover, by having the pressure vessels removably connected to one another, the ORC system makes it easier to substitute other components as necessary. The use of redundant components (see FIGS. 4-7) allows the ORC system to continue operating even when one of the main components of the ORC system is not operating properly. More specifically, the redundant component allows the ORC system to maintain a power rating even when the corresponding main component is malfunctioning. In some embodiments in which a main component and a redundant component are housed in separate pressure vessels, service or routine maintenance may be performed on one component without requiring any shutdown of the ORC system.

Although the present invention has been described with reference to preferred embodiments, workers skilled in the art will recognize that changes may be made in form and detail without departing from the spirit and scope of the invention.

The invention claimed is:

1. An organic Rankine cycle (ORC) system for generating electrical power using a sub-sea geothermal source from a sea, the ORC system comprising:

a first pressure vessel containing an evaporator configured to receive heat from the sub-sea geothermal source and vaporize an organic fluid passing through the first pressure vessel;

a second pressure vessel removably connected to the first pressure vessel and containing a turbine configured to receive the organic fluid and expand the fluid to produce mechanical shaft energy convertible to electrical power;

a third pressure vessel removably connected to the second pressure vessel and containing a condenser configured to condense the vaporized organic fluid flowing from the second pressure vessel and reject heat to cold sea water; and a fourth pressure vessel removably connected to the third pressure vessel and the first pressure vessel, and containing a pump configured to increase a pressure of the condensed organic fluid and recycle the organic fluid to the first pressure vessel.

2. The ORC system of claim 1 wherein the pressure vessels are configured to be located on, near or below a sea floor.

3. The ORC system of claim 1 further comprising:

a fifth pressure vessel containing a controller configured to monitor and control operation of the evaporator, the turbine, the condenser and the pump.

4. The ORC system of claim 3 further comprising:

at least one redundant component selected from a group consisting of a second evaporator, a second turbine, a second condenser, and a second pump, wherein each redundant component is monitored and controlled by the controller.

5. The ORC system of claim 4 wherein the controller directs at least a portion of the organic fluid through the at least one redundant component as a function of performance of at least one of the evaporator, the turbine, the condenser and the pump.

6. The ORC system of claim 1 wherein the second pressure vessel further comprises a generator coupled to the turbine and configured to produce electrical energy.

7. The ORC system of claim 6 further comprising:

a power conditioner configured to condition the electrical energy from the generator into usable electrical power.

8. The ORC system of claim 7 further comprising:

a resistive bank configured to receive electrical power from the power conditioner in an absence of an electrical load.

9. The ORC system of claim 1 wherein the first pressure vessel contains a heat exchanger connected to the evaporator, and the geothermal source passes through the heat exchanger to transfer heat to an intermediary fluid passing through the heat exchanger.

10. A system for producing electrical power for sub-sea applications, the system comprising:

a plurality of main components configured to operate as an organic Rankine cycle (ORC) system that generates electrical power using a working fluid that circulates through the main components;

a plurality of pressure vessels removably connected to each other, wherein each pressure vessel contains a main component of the ORC system such that the working fluid circulates through each pressure vessel;

a redundant component corresponding to one of the main components of the ORC system; and a control system to control operation of the main components and the redundant component, wherein operation of the redundant component includes at least one of maintaining the redundant component in a non-operational mode, operating the redundant component simultaneously with a corresponding main component, and operating the redundant component as a substitute to the corresponding main component.

11. The system of claim 10 wherein the plurality of main components comprises:

an evaporator configured to vaporize the working fluid;

a turbine configured to receive the vaporized working fluid and expand the fluid to produce mechanical shaft energy convertible to electrical power;

a condenser configured to condense the vaporized working fluid; and a pump configured to increase a pressure of the condensed working fluid and recycle the working fluid to the evaporator.

12. The system of claim 11 further comprising a generator housed in the pressure vessel containing the turbine and coupled to the turbine to convert the shaft energy to electrical power.

13. The system of claim 12 wherein the plurality of main components further comprises a power conditioner configured to condition the electrical power from the generator into a usable format, and the redundant component includes a second power conditioner.

14. The system of claim 10 wherein the redundant component is housed in the pressure vessel containing the corresponding main component.

15. The system of claim 10 wherein a main component of the ORC system is configured to receive a sub-sea geothermal source that passes through the main component and vaporizes the working fluid circulating through the ORC system.

16. A method of generating electrical power for sub-sea applications using an organic Rankine cycle (ORC) system having each of an evaporator, a turbine, a condenser and a pump inside a separate pressure vessel to form a series of vessels removably connected to one another and configured to be placed proximate to a sea floor, the method comprising:

circulating an organic fluid through the pressure vessels;

generating mechanical shaft power using the organic fluid; and converting the mechanical shaft power to electrical power.

17. The method of claim 16 further comprising:

supplying heat from a sub-sea geothermal source to the evaporator to vaporize the organic fluid; and supplying cold sea water to the condenser to condense the organic fluid in the condenser.

18. The method of claim 16 wherein the evaporator, the turbine, the condenser and the pump constitute main components of the ORC system, and the method further comprises:

monitoring operation of the evaporator, the turbine, the condenser, and the pump; and flowing the organic fluid through at least one redundant ORC component selected from a group consisting of a second evaporator, a second turbine, a second condenser, and a second pump.

19. The method of claim 18 wherein the at least one redundant ORC component is housed in the pressure vessel containing a corresponding main component.

20. The method of claim 19 wherein the pressure vessel containing the main component and the at least one redundant component further includes a controller configured to control operation of the main component and the at least one redundant ORC component.

* * * * *